United States Patent [19]

King et al.

[11] Patent Number: 4,583,312

[45] **Date of Patent: * Apr. 22, 1986**

[54] CHANGEABLE SIGN BOARD WITH MAGNETIC CHARACTERS

[75] Inventors: Edward C. King; Larry G. Robinson, both of Eugene, Oreg.

[73] Assignee: King Design, Inc., Eugene, Oreg.

[ * ] Notice: The portion of the term of this patent subsequent to Apr. 2, 2002 has been disclaimed.

[21] Appl. No.: 515,377

[22] Filed: Jul. 18, 1983

[51] Int. Cl.[4] ..... G09F 7/04

[52] U.S. Cl. ..... 40/621; 40/449; 40/450; 40/600

[58] Field of Search ..... 40/621, 600, 449, 450, 40/618, 619, 620, 622, 623; 434/190, 193

[56] References Cited

U.S. PATENT DOCUMENTS

| | | | |
|---|---|---|---|
| 417,931 | 12/1889 | Miatt | 40/621 |
| 755,272 | 3/1904 | Burnham | 40/450 |
| 1,357,457 | 11/1920 | Jorgensen | 40/450 |
| 1,531,070 | 3/1925 | Bruns | 40/621 |
| 1,679,520 | 8/1928 | Giroux | 40/447 |
| 3,074,193 | 1/1963 | Munson | 40/600 |
| 3,365,824 | 1/1968 | Winrow | 40/449 |
| 3,726,026 | 4/1973 | Borcherding | 40/600 |
| 3,769,720 | 11/1973 | Terrones | 40/621 |
| 3,782,016 | 1/1974 | Ashton et al. | 40/451 |
| 3,988,845 | 11/1976 | Boatman | 40/621 |
| 4,115,936 | 9/1978 | Nidelkoff | 40/449 |
| 4,164,824 | 8/1979 | Nidelkoff | 40/450 |
| 4,223,464 | 9/1980 | Winrow | 40/449 |
| 4,242,823 | 1/1981 | Bruno | 40/621 |
| 4,251,936 | 2/1981 | Ferrell | 40/621 |
| 4,366,637 | 1/1983 | Dechamps | 40/600 |
| 4,507,888 | 4/1985 | Robinson et al. | 40/621 |

FOREIGN PATENT DOCUMENTS

| | | | |
|---|---|---|---|
| 316111 | 3/1934 | Italy | 40/621 |
| 19908 | of 1905 | United Kingdom | 40/621 |

OTHER PUBLICATIONS

Rubber Magnet ad, Charles Mayer Studios Inc., 1960.

*Primary Examiner*—John J. Wilson

*Attorney, Agent, or Firm*—Klarquist, Sparkman, Campbell, Leigh & Whinston

[57] ABSTRACT

A changeable sign includes a flat magnetizable sheet metal sign board, and a plurality of trapezoidal segments of magnetic sheet material sized and arranged to form segmented alphanumeric characters magnetically adhered to the board. The board also includes space to apply a sheet of magnetic material containing printed information. Semi-invisible guidelines on the board, such as glossy lines on a flat background of the same color, guide the positioning of the segments to form the characters. The segments are formed with non-acute angle corners to maximize adherence at their corners. The segments are rearranged to form different characters and can be repositioned at will on the sign board over the guidelines to completely alter the sign format.

15 Claims, 4 Drawing Figures

CHANGEABLE SIGN BOARD WITH MAGNETIC CHARACTERS

BACKGROUND OF THE INVENTION

This invention relates to changeable signs, and more particularly to signs displaying changeable characters such as numbers indicating prices.

Changeable signs have long been used in a variety of businesses to advertise the prices of various products or services. Such signs are particularly useful to gasoline service stations for posting the prices of various grades of gasoline. The prices of gasoline fluctuate, requiring frequent updating of the signs. Changeable signs are also used to advertise sales on other products and services offered by the service stations.

A variety of changeable sign boards have been proposed to make updating of the signs as easy as possible. One is a sign board comprising a flat metal or wooden board upon which metal rectangular panels are mounted by means of a hook and eye arrangement, a different metal panel being provided for each number from zero to nine. Other forms of such signs provide for flip-down number panels or insertable numerals, such as disclosed in U.S. Pat. No. 3,074,193 to Munson. One drawback of this form of changeable sign is that ten panels are required to cover all of the variations of each numeral on the sign. A price sign displaying two different prices of gasoline would thus require numerous different panels to cover all the various price possibilities within three digits. Another drawback is that such signs are ordinarily very limiting in terms of format. They cannot be altered at will to display completely different information.

Changeable signs have also been provided in the form of a two-dimensional array or grid of lights which are selectively switched on and off to form a desired number or other character. A variation of this idea, using an array of circular discs, oppositely colored on opposite sides, in openings in a sign board mounted on a magnetically rotatable shaft is disclosed in U.S. Pat. No. 3,365,824 to Winrow. Depending on which sides of the eleents are exposed, different numeric characters are formed. A similar arrangement for forming alphabetic characters is also disclosed in U.S. Pat. No. 1,679,520 to Giroux. In U.S. Pat. No. 4,223,464, Winrow proposes another changeable numeric display in which the rotatable display elements are elongated segments positioned to define vertical and horizontal sides of a figure eight.

U.S. Pat. Nos. 4,115,936 and 4,164,824 to Nidelkoff disclose changeable character signs having elongated shutters mounted for sliding or pivotal movement in openings in a sign board for selectively opening and closing the openings to define segmented numeric characters on the sign board. Discrete magnets are mounted in the handle of each shutter to releasably secure the shutter along the edge of the opening in the sign board in an open or closed position. These shutters are also arranged in a figure eight pattern to form various numerals. U.S. Pat. No. 755,272 similarly provides a changeable sign having an array of hinged elements which are pivoted between open and closed positions to selectively expose or cover surfaces of contrasting color to define various alphanumeric characters.

All of these sign arrangements are susceptible to damage, particularly when placed outside, such as in front of a gasoline service station. These signs are also much more complicated and expensive than desired for many applications. Additionally, none of the foregoing changeable sign structures provide a convenient means for completely changing the information displayed on the signs. All of them are limited in some respect to displaying solely the characters defined by the elements arranged on the face of the sign.

Accordingly, a need remains for a simpler, more versatile, less expensive and more durable form of changeable sign.

SUMMARY OF THE INVENTION

A changeable sign in accordance with the invention comprises a sign board defining a continuous surface and a plurality of elongated segments sized and arranged on the sign board in a predetermined pattern to define a segmented alphanumeric character, such as a numeral. One of the sign board and the segments is composed of magnetic material, and the other of magnetizable material, so that the segments are adhered to the board by magnetic attraction and accordingly are removable therefrom for rearranging into any other desired segmented character. The segments and the board have visibly contrasting surfaces so that the characters formed by the segments applied to the board are visible at a distance.

Preferably, up to seven segments or strips of flexible magnetic sheet material are arranged on a sheet steel sign board in accordance with the pattern of a figure eight numeral, selected segments being omitted to form other desired numerals. The seven segments preferably include a single hexagonal segment and up to six generally trapezoidal segments. The base angle corners of the trapezoidal segments are truncated so as to provide a pair of obtuse angle corners, instead of a single acute angle corner, to aid in adhering the segments to the sign board.

Also, the sign board preferably includes index means comprising guidelines in the form of an outline or template of the segments arranged in a figure eight pattern to aid in positioning the segments to form different numerals. The index means is visible at a position close to the sign, such as at a distance of a few feet from it, and invisible at a normal viewing distance from the sign, for example, a dozen or more feet away. Such index means can be provided by a guideline of substantially the same color as the surface of the board, but of contrasting reflectance, for example, by glossy finish lines on a flat finish board surface.

An area can be provided on the sign board adjacent the area covered by the numerals for applying a sheet of magnetic material with additional information printed thereon. Alternately, all or a portion of the sign board surface which normally receives the numeric segments can be used instead to receive a large magnetic information sheet. Accordingly, the sign board and index means is preferably substantially planar. The term substantially planar can include slightly concave, convex or other continuous surface shapes which allow magnetic segments or sheets of different dimensions to be applied to the sign board and adhered contiguously to its surface.

Other objects, features and advantages of the invention will become more readily apparent from a detailed description of a preferred embodiment which proceeds with reference to the accompanying drawing.

DETAILED DESCRIPTION

Figure 1:
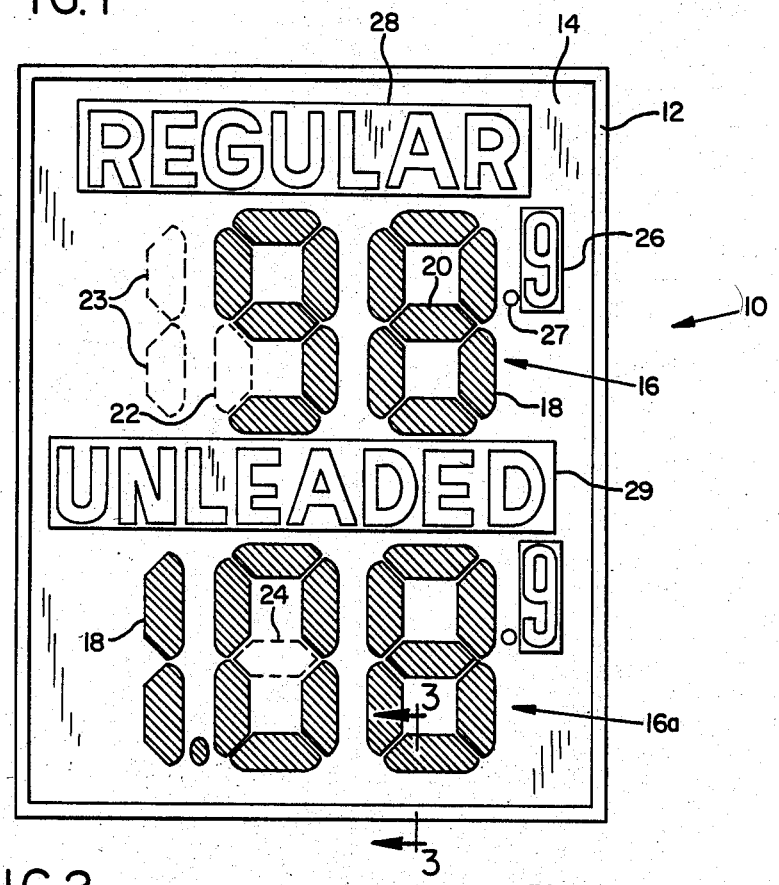
FIG. 1 is a front elevational view of a changeable sign board in accordance with the invention, illustrating use to post gasoline prices.

Referring to FIG. 1, a gasoline price sign 10 in accordance with the invention comprises a rectangular frame 12 supporting a flat rectangular sheet 14 of magnetizable metal, such as sheet steel. The metal sheet has a front surface finish of a selected color, such as a baked enamel finish in flat black. Two arrays of numerals 16, 16*a*, of up to three digits each, are formed by elongated strips or segments 18, 20. The segments are made of rubberized or plastic flexible magnetic sheet material such as is manufactured by The Magnetic Factory, Cincinnati, Ohio. This material is provided in large sheets and is die cut to form segments 18, 20. As indicated by shading in FIGS. 1 and 2, the segments are surfaced in a contrasting color, such as white or fluorescent orange.

Figure 4:
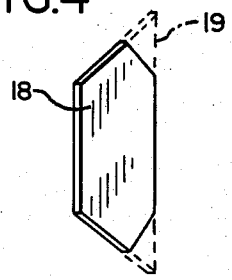
FIG. 4 is a perspective view of a single strip of flexible magnetic material as used to form the segments of the numerals in the signs of FIGS. 1 and 2.

Segments 18, defining the lateral and upper and lower sides of each numeral, are cut in a generally trapezoidal shape. Referring to FIG. 4, this shape is only generally trapezoidal in that the base corners 19 are truncated to provide a pair of obtuse angle corners, rather than a single acute angle corner. Acute angle corners tend to curl, detaching from the sign board, sometimes sufficiently to be caught by the wind with the result that the entire strip is detached from the board. Non-acute angle corners provide sufficient adherence to resist unintended detachment and at the same time lend a more readable, rounded shape to the characters formed by the strips. The middle segment 20 of each numeral is cut to a hexagonal shape.

An outline or template to aid in positioning elements 18, 20 is formed on the sign board by nearly invisible guidelines 22, 23, 24. So that the lines will be visible close up, but invisible at a normal viewing distance, such lines are formed on the surface of the sign board in the same color as the finish of the sign board, but in a paint of different reflectance. For example, on a flat black surfaced sign board, the lines are silk-screened in glossy black.

Outlines 22 are generally trapezoidal and outlines 24 are hexagonal, and such outlines are arranged in the pattern of a figure eight to aid in positioning segments 18, 20 to form any numeral from zero to nine. Outlines 23 are trapezoidal and positioned in a vertical line to form a numeral one.

In addition to numerals 16, 16*a*, other numerals can be provided. For example, a small numeral 9 printed on a rectangular sheet 26 of the aforementioned magnetic material can be used in conjunction with a circular element 27, formed of the same material, to denote decimal fractional price. Additional information, such as the type of gasoline being offered at each price, can be printed on rectangular sheets 28, 29 of magnetic material adhered to an area of sign board 14 adjacent the numerals 16, 16*a*, respectively.

Figure 3:
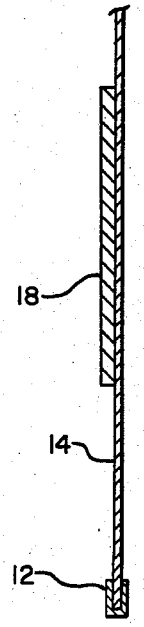
FIG. 3 is an enlarged sectional view taken along line 3—3 of FIG. 1.
Figure 2:
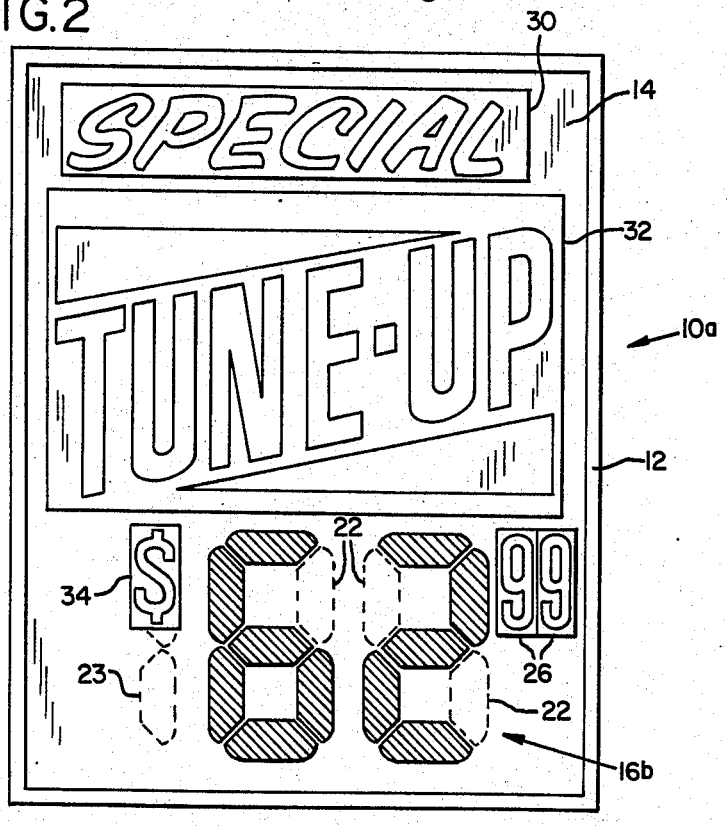
FIG. 2 is another front elevational view of the sign board of FIG. 1, modified to display in different form at the price of a selected service offered by a gas station.

Referring to FIG. 3, the sign board 14 has a continuous, flat surface. This feature enables the sign to be completely changed, even to the point of eliminating some or all of the numerals formed by strips 18, 20. As illustrated in FIG. 2, numerals 16 and sign elements 28, 29 are removed. Two rectangular sheets 30, 32 of magnetic material of different sizes are adhered to the surface of sign board 14 in their stead. In this example, sheet 32 covers all of the guidelines 22, 23 which defined numeral 16 in FIG. 1. The numerals 16*b* in FIG. 2 also illustrate how a displayed price can be changed simply by adding and removing selected ones of strips 18, 20, deleting the decimal point 27 and adding a second small numeral 9 on another sheet 26 and a dollar sign on sheet 34.

Having illustrated and described the principles of our invention in a preferred embodiment thereof, it should be readily apparent to those skilled in the art that the invention can be modified in arrangement and detail without departing from such principles. We claim as our invention all modifications coming within the scope and spirit of the following claims:

We claim:

1. A changeable sign comprising:

means defining a continuous support surface;

a plurality of separate segments arrangeable in different patterns on said surface to define different alphanumeric characters;

one of said surface and said segments being magnetic;

the other of said surface and said segments being magnetizable such that said segments can be magnetically adhered to said surface in different desired alphanumeric patterns and selectively removed therefrom;

the segments and support surface having visibly contrasting surfaces so that said characters are visible;

the support surface including index means defining outlines of seven of said segments arranged in a figure-8 pattern for guiding arrangement of the segments to form a numeral, the index means being visible at a first position close to the sign and invisible at a second position spaced from the sign and the first position.

2. A sign according to claim 1 in which said index means comprises a line of substantially the same color as the support surface but of contrasting reflectance.

3. A sign according to claim 2 in which the support surface has a flat finish and the line is defined by a glossy finish.

4. A sign according to claim 1 in which the segments comprise generally trapezoidal strips of flexible magnetic sheet material having acute angle base corners which are truncated.

5. A sign according to claim 4 in which said corners are truncated so as to form a pair of non-acute angle corners at each base corner of the strip.

6. A sign according to claim 4 in which the segments defining a single said numeral consist of a single hexagonal strip and no more than six of said generally trapezoidal strips.

7. A sign according to claim 1 in which the support surface includes a first area on which at least two of said numerals are arranged and a second adjacent area having a first sheet of magnetic material adhered thereto, the first sheet having information visibly displayed thereon;

the sign board being substantially planar contiguously over the first and second areas so that upon removal of said numerals and first sheet from the board a second sheet can be adhered to the sign board surface in a position overlapping said areas to display different information thereon.

8. A changeable sign comprising:

a sign board of magnetizable sheet metal providing a continuous, substantially planar support surface;

a first surface finish of a predetermined color and a first reflectance covering the support surface;

a semi-invisible outline of a segmented numeral 8 formed on the support surface in said predetermined color and a second contrasting reflectance; and a plurality of segments of magnetic sheet material magnetically adhered to the support surface;

the segments being sized and arranged on the support surface within said outline to define the shape of a predetermined numeral and having a second surface finish of a contrasting color.

9. A method of forming a sign comprising:

providing a magnetizable sheet of metal defining a sign board having a continuous support surface;

providing on the surface of the sign board a semi-invisible guideline defining a segmented figure-8 pattern;

cutting a plurality of elongated segments of magnetic sheet material to a predetermined size and shape conforming to a portion of said pattern; and arranging and magnetically adhering the strips to the support surface in accordance with said figure-8 pattern to define a first segmented numeric character.

10. A method according to claim 9 comprising removing or adding one of said segments to the board surface within said pattern to change said first character to a second said character.

11. A method according to claim 9, wherein the support surface and the means defining the guideline form a substantially planar surface, including removing the segments and applying a sheet of said magnetic sheet material with information printed thereon to an area of the sign board surface covering at least a portion of the guideline, to change the sign.

12. A method according to claim 9 in which the cutting step includes forming the segments of flexible material with non-acute angle corners.

13. A method of forming a sign including changeable numeric characters, comprising:

providing a sign board having a flat, continuous support surface;

providing on the sign board support surface a visible pattern defining a figure-8;

forming a plurality of segments of flat sheet material, each segment sized and shaped to conform to a portion of the figure-8 pattern so that different numerals from zero to nine can be formed by arranging different combinations of the segments within the figure-8 pattern;

arranging the segments in conformity with the figure-8 pattern so as to form a selected one of said numerals in visible contrast to a portion of the sign board surface surrounding the figure-8 pattern; and magnetically adhering the segments to the sign board.

14. A method according to claim 13 including changing the position of at least one of said segments within the figure-8 pattern so as to form a second one of said numerals.

15. A method according to claim 13 in which no more than seven of said segments are used to form one of said numerals.

* * * * *